United States Patent [19]

Johnson et al.

[11] Patent Number: 4,479,809

[45] Date of Patent: Oct. 30, 1984

[54] APPARATUS FOR GASIFYING COAL INCLUDING A SLAG TRAP

[75] Inventors: Everett M. Johnson, Fishkill, N.Y.; Warren G. Schlinger, Pasadena, Calif.

[73] Assignee: Texaco Inc., White Plains, N.Y.

[21] Appl. No.: 449,110

[22] Filed: Dec. 13, 1982

[51] Int. Cl.[3] ..... C10J 3/08

[52] U.S. Cl. ..... 48/77; 48/69; 48/128; 48/DIG. 2; 55/239; 55/261; 55/340

[58] Field of Search ..... 55/237, 236, 238, 459 R, 55/239, 261, 340; 48/DIG. 2, 67, 69, 77, 128; 122/390, 391; 110/215, 216; 261/79 A

[56] References Cited

U.S. PATENT DOCUMENTS

| | | | |
|---|---|---|---|
| 3,412,529 | 11/1968 | Tailor | 55/236 X |
| 3,600,817 | 8/1971 | Klein | 55/261 X |
| 3,618,299 | 11/1971 | Vincent | 55/236 |
| 3,641,743 | 2/1972 | Hoffmann et al. | 55/236 |
| 3,653,187 | 4/1972 | Petersen | 55/230 |
| 3,684,093 | 8/1972 | Kono et al. | 55/261 X |
| 4,252,543 | 2/1981 | Giles | 48/197 R |
| 4,377,132 | 3/1983 | Koog et al. | 48/69 X |

*Primary Examiner*—Peter F. Kratz
*Assistant Examiner*—Joye L. Woodard
*Attorney, Agent, or Firm*—Robert A. Kulason; Robert Knox, Jr.; Henry C. Dearborn

[57] ABSTRACT

A slag trap structure is for use where synthesis gas is generated having small particulate slag entrained therewith. It has a high pressure shell with a body of water at the bottom for quenching and removing the slag. There is a coaxial inner wall to direct the flow of synthesis gas and slag down from an inlet at the top toward the body of water. And there is an outlet spaced substantially above the level of the water to cause reversal of the gas and slag flow. Also, there is means for recirculating some clean gas in conjunction with the inner wall to direct a swirling flow that confines the downward flow centrally in the vessel.

4 Claims, 5 Drawing Figures

APPARATUS FOR GASIFYING COAL INCLUDING A SLAG TRAP

BACKGROUND OF THE INVENTION

1. Field of the Invention

This invention concerns coal gasification and the like that employs a high pressure procedure which generates small particulate slag that becomes entrained with the synthesis gas generated. More particularly the invention concerns a slag trap structure that is particularly adaptable to the foregoing high pressure gasification procedure.

2. Description of the Prior Art

It has been found that in the generation of synthesis gas from finely divided materials, such as powdered coal, the use of a high pressure synthesis gas generator tends to develop slag that is only partially removed in a liquid state by run off from the reactor. And, the process also tends to develop a substantial quantity of small particulate slag that becomes entrained with the synthesis gas as it is produced. Such small particulate slag tends to be carried over with the synthesis gas to equipment which follows such as a waste heat boiler. And, in such equipment the slag tends to deposit out and foul the boiler tubes or the like.

Consequently, it is an object of this invention to provide a slag trap structure which enables the small particulate slag that is entrained with synthesis gas, to be removed in a high pressure vessel where some clean synthesis gas is recirculated to assist in the removal process.

SUMMARY OF THE INVENTION

Briefly, the invention is in combination with high pressure coal gasification and the like where small particulate slag is generated. It concerns a slag trap which comprises a high pressure vessel having an inlet at the top for receiving synthesis gas containing small particulate slag entrained therewith. The said vessel comprises a shell for containing said high pressure, and means for maintaining a body of water at the bottom of said shell underneath said inlet. The vessel also comprises coaxial wall means for confining said synthesis gas and entrained slag to downward flow towards said body of water. And, an outlet for said synthesis gas is spaced substantially above the bottom of said coaxial wall to cause reversal of said synthesis gas and entrained slag flow above said body of water, whereby said slag is quenched and retained by the water while the synthesis gas flows to said outlet.

Once more briefly, the invention is in combination with high pressure coal gasification and the like where small particulate slag is generated. It concerns a slag trap which comprises a high pressure vessel having an inlet at the top for receiving synthesis gas containing small particulate slag entrained therewith. The said vessel comprises a shell for containing said high pressure, and means for maintaining a body of water at the bottom of said shell underneath said inlet. The vessel also comprises first coaxial wall means for confining said synthesis gas and entrained slag to downward flow toward said body of water. The first coaxial wall means comprises a plurality of passages therethrough for directing a swirling flow therein. The vessel also comprises means for recirculating some of said synthesis gas through said plurality of passages, which means comprises a second coaxial wall means between said shell and said first coaxial wall means. And, the vessel comprises an annular means for closing the space between said first coaxial wall means and said second coaxial wall means. The vessel also comprises an inlet to said space for introducing said recirculated synthesis gas comprising a plurality of tangentially directed conduits. And, the vessel comprises an outlet for said synthesis gas spaced substantially above the bottom of said first and second coaxial wall means to cause reversal of said synthesis gas and entrained slag flow above said body of water, whereby said slag is quenched and retained by said water while the synthesis gas flows to said outlet.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

In high pressure coal gasification procedures which employ gasification of finely divided solids such as powdered coal, the procedure develops liquid slag some of which tends to be entrained in finely divided form with the synthesis gas which exits from the generator. As the synthesis gas with entrained small particulate slag is cooled the slag tends to deposit out on the surfaces of a structure following the generator, such as a waste heat boiler. Consequently, the efficacy of the boiler is greatly reduced and the boiler tubes tend to become fouled. However, by employing a slag trap according to this invention the entrained slag may be confined to the center of a swirling fluid flow that is directed toward a body of water. Thus the slag is thrown out and quenched by the water as the flow of gas and slag is reversed. This takes place without substantial deposit of the slag on any surface of the slag trap.

Figure 1:
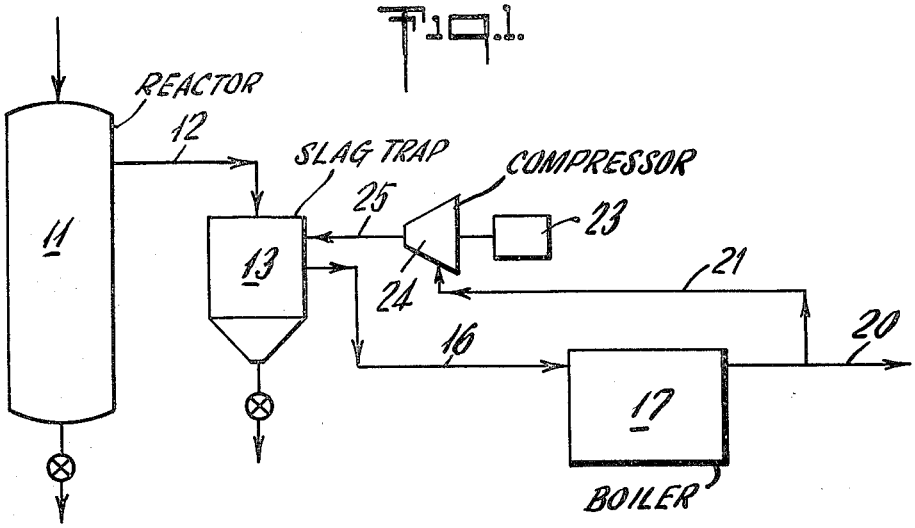
FIG. 1 is a schematic diagram illustrating a system in which a slag trap according to the invention is included.

The arrangement involves the recirculation of some clean synthesis gas following the removal of the slag. And, a system wherein a slag trap according to this invention is employed is illustrated in FIG. 1. Thus, there is illustrated a high pressure synthesis gas reactor 11 from which the synthesis gas generated therein (having entrained small particulate slag therewith) flows over a conduit 12 into the top of a slag trap 13. It then goes out from the slag trap 13 at a point well above the bottom and over an exit conduit 16 which leads to a waste heat boiler 17. Thereafter it continues on over a conduit 20 for utilization while a portion is recirculated over a return line 21 to the input side of a compressor 24 which is driven by a motor 23. The compressor 24 returns that portion of the clean synthesis gas determined by the relative size of the return line 21, to a return conduit 25 which leads back into the slag trap 13. Such return is carried out in a manner that will be more fully described hereafter in connection with the details of the slag trap.

Figure 5:
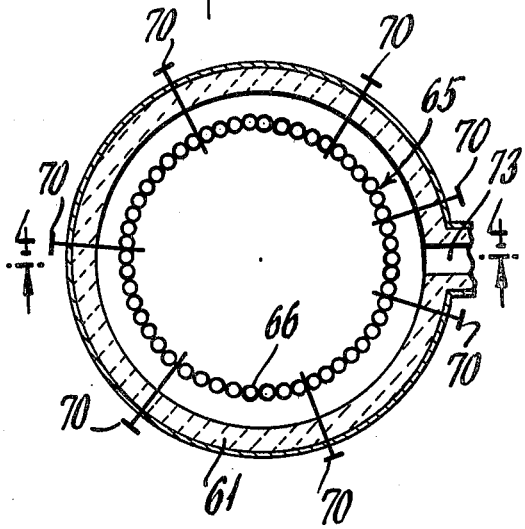
FIG. 5 is a horizontal cross section view taken along the lines of 5—5 of the FIG. 4 modification.

A slag trap according to the invention may take different forms, e.g. the two modifications that are illustrated. One modification is illustrated by FIGS. 2 and 3, while FIGS. 4 and 5 show another.

Figure 2:
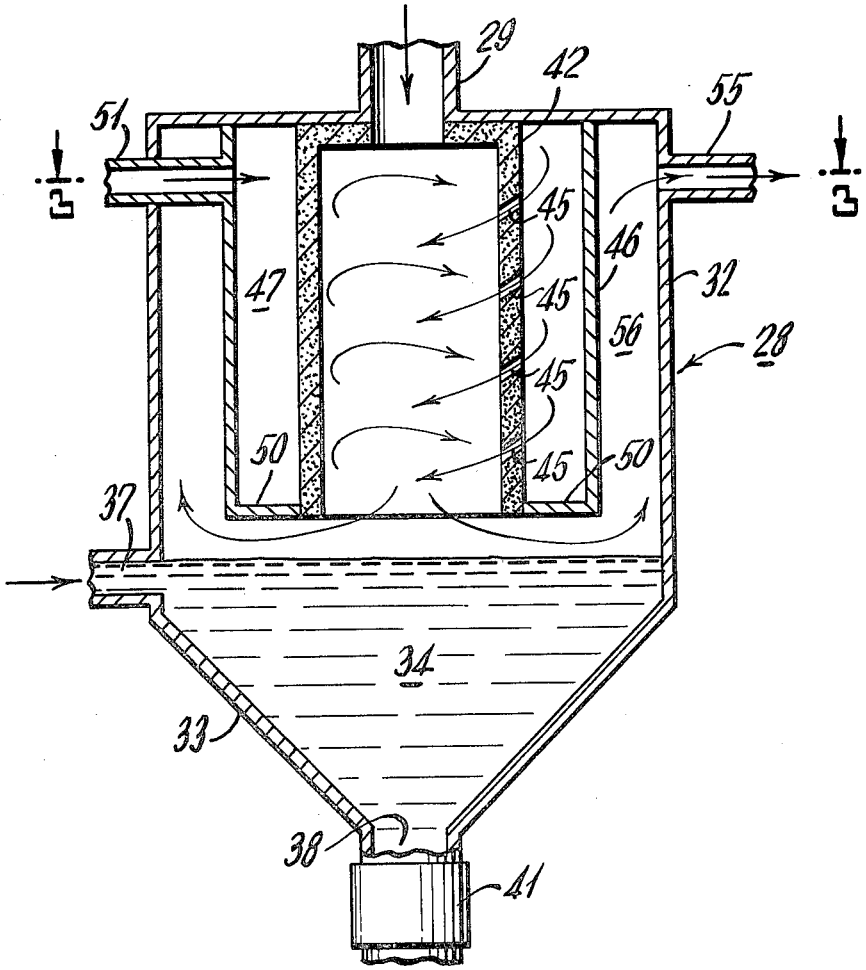
FIG. 2 is a schematic longitudinal cross section taken along the lines 2—2 on FIG. 3 showing one modification of a slag trap structure according to the invention.
Figure 3:
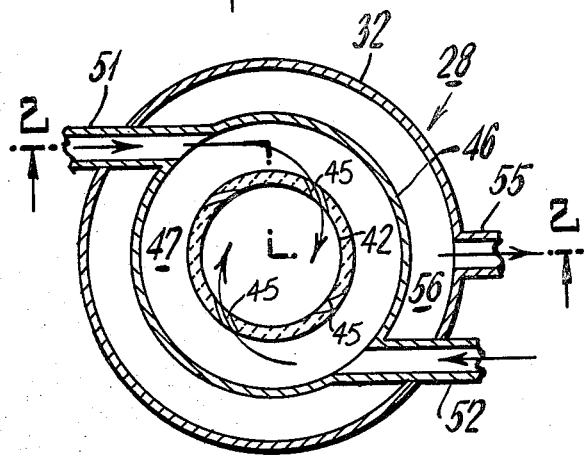
FIG. 3 is a reduced horizontal cross section view taken along the lines 3—3 of FIG. 2 and looking in the direction of the arrows.
Figure 4:
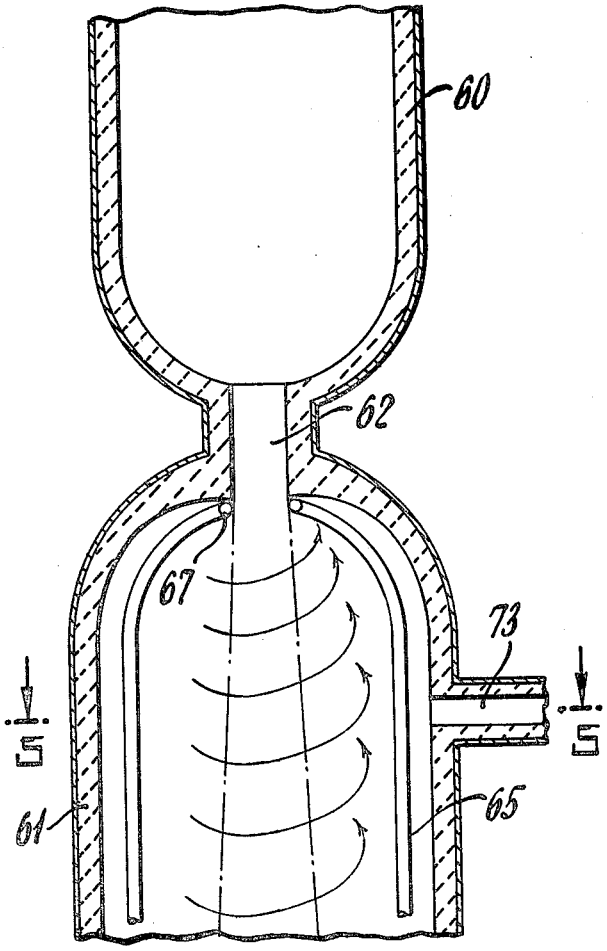
FIG. 4 is a schematic longitudinal cross section showing of another modification of structure according to the invention. It has the slag trap structure attached beneath a generator of the synthesis gas and slag.

With reference to FIGS. 2 and 3, it should be noted that the slag trap according to this modification includes a high pressure vessel 28 that is cylindrical and has an inlet 29 axially located at the top. It will be understood that the synthesis gas containing small particulate slag entrained therewith, is introduced through the inlet 29 and is directed down through the center of the vessel 28.

The vessel 28 is made up of a shell 32 that contains the high pressure condition of the synthesis gas flowing therein. The shell 32 is shaped at the bottom in any feasible manner, such as a frusta conical portion 33 which contains a body of water 34 therein. There is of course, an inlet 37 on one side of the bottom portion 33 for introducing added water when necessary.

Also, there may be a lock hopper (not shown) connected to an outlet 38 at the bottom of the portion 33 which contains the body of water 34. There is a valve 41 to regulate the removal of water and quenched slag to the lock hopper.

Inside the shell 32 there is a refractory material coaxial wall 42 that confines the flow of synthesis gas with entrained slag downward within the shell 32, towards the body of water 34. This refractory wall 42 has a plurality of passages 45 that are tangentially directed through the refractory wall structure 42. Outside of the refractory wall 42 there is a second coaxial wall 46 that is between the shell 32 and the refractory wall 42, so as to form a space 47 there between. The wall 46 connects into the top of the shell 32. And, there is an annular bottom connection 50 that closes the space 47. There is an inlet to the space 47, that is formed by a pair of tangentially directed conduits 51 and 52 (see FIG. 3). These conduits 51 and 52 are connected to a source of clean synthesis gas. Such a source is indicated by the line 25 shown in FIG. 1. It may be noted that the conduits 51 and 52 help in providing the desired swirling flow of the recirculating synthesis gas. This flow goes circumferentially around in the space 47 and so through the tangential passages 45 to cause a swirling flow in the center of the slag trap 28. Such swirling flow acts to confine the particulate slag to the central portion of the trap 28 and keep it from depositing out on the surfaces of the refractory wall 42.

The shell 32 has an outlet 55 that is spaced substantially above the bottom of the coaxial refractory wall 42 so as to cause a reversal of flow of the synthesis gas with entrained particles. This reversal takes place at the surface of the water 34 where it then flows upward in an annular space 56 in order to reach the outlet 55. It will be understood that if the slag trap 28 is employed in a system such as that indicated in FIG. 1, the outlet 55 would be connected to the exit conduit 16 and the clean synthesis gas would then go to the waste heat boiler 17. Thereafter a portion would be recirculated so as to return in the above indicated manner through the tangentially directed inlet conduits 51 and 52.

Another modification of a slag trap in accordance with this invention is illustrated in FIGS. 4 and 5. It will be observed that this trap structure is adapted for mounting directly beneath a synthesis gas generator 60. Consequently it receives the synthesis gas with small particulate slag entrained therewith, directly from the bottom exit of the generator 60. In this modification, the trap consist of a shell 61 that is connected into the bottom of the generator 60 so as to form an inlet 62 at the top of the shell 61. There is a coaxial wall 65 inside the shell 61. And, this coaxial wall 65 is made up of water tubes 66 that are shaped at the top and connected into a manifold 67. Consequently, the wall 65 may act as a steam generator in absorbing radiant heat from the synthesis gas and entrained slag. The heat transfer takes place inside of the vessel formed by the shell 61.

There are a plurality of passages through the wall 65 that is formed by the tubes 66. These passages are made up of a plurality of soot blowers 70. These soot blowers 70 are schematically indicated, and they may take various well known forms. However, the exit nozzles (not shown) of the soot blowers 70 are directed in a tangential manner inside of the wall 65. Consequently, clean synthesis gas may be directed through the soot blowers 70 so as to cause a swirling flow inside. Such swirling flow will confine the slag containing synthesis gas coming from the generator 60, to the central portion of the vessel 61.

It will be understood that clean synthesis gas being recirculated will be connected to the soot blowers 70 by any feasible connection (not shown). And, preferably the tangential direction of the clean recirculated synthesis gas will be such as to oppose the circulation that would tend to be developed by gravity and the earths rotation.

In the modified trap structure of FIGS. 4 and 5 there is a bottom structure (not shown), for containing a body of water (not shown), in a manner similar to that indicated in the earlier described modification illustrated by FIGS. 2 and 3. Also, it will be noted that there is an outlet 73 through the shell 61. And, the outlet 73 is located a substantial distance above the surface of the body of water (not shown) so as to cause a reversal of the flow of the synthesis gas and entrained slag. Such reversal takes place at the bottom (not shown) of the water wall 65.

It will be observed that in both modifications according to this invention, there is a slag trap structure which is adapted for making use of the recirculation of some of the synthesis gas from a generator to provide a swirling effect in the trap. And, such swirl confines the synthesis gas laden with particulate slag to the center portion of the trap while directing it down toward a body of water where the flow reversal tends to remove and quench the particulate slag that is entrained therewith.

It will be noted that in the modification illustrated by FIGS. 4 and 5, the hot combustion chamber synthesis gas products are used to generate steam, while at the same time the gases are cooled. Such water walled structure replaces the refractory wall of the modification illustrated in FIGS. 2 and 3 and the inlet swirl in FIGS. 4 and 5 is created by aiming the soot blower nozzles to cause tangential flow. It may also be noted that the flow of recirculated synthesis gas through the soot blowers might be alternated between various inlet ports (not shown) of the soot blowers, if desired.

While particular embodiments of the invention have been described above in accordance with the applicable statues, this is not to be taken as in any way limiting the invention but merely as being descriptive thereof.

We claim:

1. In combination with a high pressure coal gasifier where small particulate slag is generated, a slag trap comprising a high pressure vessel having an inlet at the top for receiving synthesis gas containing small particulate slag entrained therewith, said vessel comprising a shell for containing said high pressure, means for maintaining a body of water at the bottom of said shell underneath said inlet, first coaxial wall means for confining said synthesis gas and entrained slag to downward flow toward said body of water, comprising a plurality of passages therethrough for directing swirling flow therein, means for recirculating some of said synthesis gas through said plurality of passages, comprising a second coaxial wall between said shell and said first coaxial wall means, annular means for closing the space between said first coaxial wall means and said second coaxial wall means, an inlet to said space for introducing said recirculated synthesis gas comprising a plurality of tangentially directed conduits, and an outlet for said synthesis gas spaced substantially above the bottom of said first and second coaxial wall means to cause reversal of said synthesis gas and entrained slag flow above said body of water whereby said slag is quenched and retained by said water while the synthesis gas flows to said outlet.

2. The invention according to claim 1, wherein said first coaxial wall means comprises a refractory cylindrical wall connected to said synthesis gas inlet at the top and open at the bottom above said body of water.

3. The invention according to claim 2, wherein said plurality of passages are tangentially directed.

4. In combination with a high pressure coal gasifier where small particulate slag is generated, a slag trap comprising a high pressure vessel having an inlet at the top for receiving synthesis gas containing small particulate slag entrained therewith, said vessel comprising a shell for containing said high pressure, means for maintaining a body of water at the bottom of said shell underneath said inlet, a refractory coaxial wall connected to said synthesis gas inlet at the top and open at the bottom above said body of water, for confining said synthesis gas and entrained slag to downward flow toward said body of water, said wall having a plurality of tangentially directed passages therethrough for causing a swirling flow therein, an outlet for said synthesis gas spaced substantially above the bottom of said coaxial wall to cause reversal of said synthesis gas and entrained slag flow above said body of water whereby said slag is quenched and retained by the water while clean synthesis gas flows to said outlet, means for recirculating some of said clean synthesis gas through said plurality of passages, said means for recirculating comprises an additional coaxial wall between said shell and said coaxial wall means.

annular means for closing the space between said coaxial wall means and said additional coaxial wall, and an inlet to said space for introducing said recirculated clean synthesis gas.

* * * * *